US009399883B2

(12) United States Patent
Swoboda et al.

(10) Patent No.: US 9,399,883 B2
(45) Date of Patent: Jul. 26, 2016

(54) AUTOMATICALLY OPERATED DOOR SYSTEM FOR AN AIRCRAFT TOILET

(71) Applicants: Sebastian Swoboda, Hamburg (DE); Eric Stuchly, Hamburg (DE)

(72) Inventors: Sebastian Swoboda, Hamburg (DE); Eric Stuchly, Hamburg (DE)

(73) Assignee: DIEHL COMFORT MODULES GMBH, Hamburg (DE)

( * ) Notice: Subject to any disclaimer, the term of this patent is extended or adjusted under 35 U.S.C. 154(b) by 0 days.

(21) Appl. No.: 13/713,146

(22) Filed: Dec. 13, 2012

(65) Prior Publication Data

US 2013/0146232 A1 Jun. 13, 2013

(30) Foreign Application Priority Data

Dec. 13, 2011 (DE) ..... 10 2011 120 839

(51) Int. Cl.
*E06B 3/32* (2006.01)
*E05D 15/26* (2006.01)
*E05F 15/605* (2015.01)

(52) U.S. Cl.
CPC ..... *E05D 15/26* (2013.01); *E05D 15/264* (2013.01); *E05F 15/605* (2015.01); *E05Y 2201/682* (2013.01); *E05Y 2900/112* (2013.01); *E05Y 2900/502* (2013.01)

(58) Field of Classification Search
CPC B64C 11/1407; B64C 1/1423; B64C 1/1468; E05D 15/264; E05F 15/605; E06B 3/805
USPC ..... 160/90, 113, 188, 199, 206, 210, 213
See application file for complete search history.

(56) References Cited

U.S. PATENT DOCUMENTS

| | | | | | |
|---|---|---|---|---|---|
| 3,213,923 | A * | 10/1965 | Richter | 160/188 |
| 3,275,064 | A * | 9/1966 | Hansen | 160/206 |
| 3,303,871 | A * | 2/1967 | Scholes | 160/188 |
| 4,026,343 | A * | 5/1977 | James | 160/189 |
| 4,044,812 | A * | 8/1977 | Swanstrom | 160/206 |
| 4,261,409 | A * | 4/1981 | De Vore | 160/207 |
| 4,276,919 | A * | 7/1981 | Walters | 160/206 |
| 4,957,600 | A * | 9/1990 | Carlson et al. | 160/199 |
| 6,470,952 | B1 * | 10/2002 | Cline et al. | 160/188 |
| 6,705,377 | B1 * | 3/2004 | Coolman | 160/118 |
| 6,732,408 | B2 * | 5/2004 | Wu | 16/298 |
| 6,866,080 | B2 * | 3/2005 | Schweiss | 160/193 |
| 7,258,153 | B2 * | 8/2007 | Chen | 160/206 |

(Continued)

FOREIGN PATENT DOCUMENTS

| | | |
|---|---|---|
| DE | 91 09 413 U1 | 10/1992 |
| DE | 10 2010 028 888 A1 | 12/2010 |

*Primary Examiner* — Katherine Mitchell
*Assistant Examiner* — Johnnie A Shablack
(74) *Attorney, Agent, or Firm* — Scully Scott Murphy and Presser

(57) ABSTRACT

An automatically operated door system for an aircraft toilet is provided. The system has a folding door and a door frame. The folding door is arranged in the door frame to be movable between a closed door position and an open door position. The system also has a drive apparatus for moving the folding door between the closed door position and the open door position, a guiding member connected to the drive apparatus and a displacement element arranged on the folding door. The guiding member engages the displacement element to transfer the driving force of the drive apparatus to the displacement element; accordingly, the folding door is moved from the closed door position into a pre-folded door position.

12 Claims, 5 Drawing Sheets

(56) References Cited

U.S. PATENT DOCUMENTS

| | | | | |
|---|---|---|---|---|
| 7,942,185 | B2 * | 5/2011 | Long | 160/213 |
| 8,096,341 | B2 * | 1/2012 | Teunissen | 160/199 |
| 8,109,315 | B2 * | 2/2012 | Schneider | 160/199 |
| 8,381,927 | B2 * | 2/2013 | Nam | 220/1.5 |
| 8,533,909 | B2 * | 9/2013 | Minegishi et al. | 16/76 |
| 2009/0178770 | A1 * | 7/2009 | Teunissen | 160/165 |
| 2010/0313482 | A1 * | 12/2010 | Minegishi et al. | 49/386 |
| 2013/0186038 | A1 * | 7/2013 | Lang | 52/745.16 |
| 2013/0292067 | A1 * | 11/2013 | Lucas | 160/213 |

* cited by examiner

AUTOMATICALLY OPERATED DOOR SYSTEM FOR AN AIRCRAFT TOILET

BACKGROUND OF THE INVENTION

The invention relates to an automatically operated door system for an aircraft toilet having a folding door and door frame wherein the folding door is arranged in the door frame so as to be movable between a closed door position and an open door position.

DISCUSSION OF THE PRIOR ART

The accommodation in aircraft is restricted, which means that it is necessary to utilize the existing space in the aircraft as efficiently as possible. For this reason, there is only limited space available for toilet areas. In order to be able to utilize the spatially restricted location of the toilet area efficiently, there is a requirement for toilet doors which, on the one hand, only need a small amount of space and, on the other hand, are able to be operated in a user-friendly manner.

DE 69308827 T2 describes a toilet door in aircraft. The toilet door is realized as a foldable toilet door by means of a first and a second door panel, the door panels being connected together by means of a hinge. On the first door panel, the toilet door has a pin, by means of which the folding door is pivotably fastened. In order to be able to open and close the door, the second door panel of the door has a guiding device which is moved along the door opening region.

SUMMARY OF THE INVENTION

The object underlying the invention is to provide an improved door system for an aircraft toilet.

An automatically operated door system is proposed, said door system being realized for an aircraft toilet. The term aircraft toilet refers to a room, frequently formed by a so-called monument, which can be installed in an aircraft as a unit, with sanitary fittings, i.e. a room in or by way of which sanitary fittings can be provided for passengers and/or air crew in an aircraft. It should be noted that the term 'toilet' should not only be understood in the narrower sense, but should also generally include fittings for personal hygiene, such as, in particular, showers, washing and bathing facilities, etc.

The automatically operated door system includes a folding door, the folding door having a folding mechanism. The folding mechanism defines a bend axis or fold axis which extends in particular axially with respect to the folding door and enables a bending or folding operation in the folding door.

As a result of the fact that that the folding door is realized for a bending operation, the folding door has at least two door portions which are connected together so as to be bendable, in particular flexible, in particular via the bend axis. In the simplest case, the folding door is realized with two folds, the invention being applicable in principle to folding doors with an arbitrary number of door folds or door portions.

Door portions separated by the folding mechanism, in particular the fold or bend axis, are connected together so as to be pivotable by means of a coupling element, for example by means of a hinge, and, as movable door portions, in particular movable towards each other, form the folding door. In a particularly preferred manner, the folding door has a bend axis arranged centrally with respect to the folding door.

The bending operation enables an opening and closing operation of the folding door. In the case of the opening operation of the folding door, the movable door portions are folded together to one side, in a preferred manner door surfaces of the movable door portions being placed next to each other, whilst in the case of the closing operation of the folding door, the door portions are folded away from one another. As compared to a standard door only a small pivoting region is present or is necessary, one advantage of the folding door is the reduction in the required space needed.

The automatically operated door system includes a door frame with a preferably horizontal narrow side and vertical longitudinal sides. The folding door is arranged in the door frame so as to be movable between a closed and an open door position such that the opening and closing operation of the folding door, in each case including a bending or folding operation, is able to be performed. In the case of the closed door position, the door portions are arranged along the narrow side of the door frame at an angle of 180° with respect to each other, in particular in an aligned manner, such that a complete demarcation between the aircraft toilet and the adjoining accommodation can be effected. In this case, in a preferred manner the sum of the widths of the door portions corresponds substantially to the width of the door system to be closed. In the case of the open door position, the door portions are arranged at right angles or at least approximately at right angle to the narrow side and/or longitudinal side of the door frame. I.e. in the open door position, the folding door is collapsed and a passage is made possible to and from the interior of the aircraft toilet or the toilet monument and/or a passage is made possible between the aircraft toilet and the adjoining accommodation.

The direction of movement of the folding door in the door frame extends along a movement axis, the movement axis being arranged in a plane which is parallel or identical to the surface extension of the folding door in the closed state and is aligned parallel to the narrow side of the door frame, the floor and/or horizontally.

In addition, the automatically operated door system has a drive apparatus which is realized for driving the automatic movement of the folding door between the closed and the open door position. The drive apparatus is preferably arranged in or on the door frame.

The automatically operated door system includes a guiding member which is coupled to the drive apparatus as well as a displacement element which is arranged on the folding door. The guide element is realized and set up for the purpose of moving the folding door from a closed door position into a pre-folded door position by transferring the driving force of the drive apparatus to the displacement element. In particular, the transfer of the driving force for changing the folding door from the closed door position into the pre-folded door position is effected on a parallel force transferring path and/or independently to the transfer of the driving force for opening the folding door completely. The displacement element and the guiding member define a first force transferring path.

Particularly advantageous to the invention is the automatic change in position of the folding door from the closed door position into the pre-folded door position. In the pre-folded door position, the door portions of the folding door are arranged with respect to each other at an angle of less than 180°, but preferably at an angle greater than 160° or 170°. This should mean in particular that the door portions are no longer arranged in an equiplanar manner in a common plane, but are arranged in intersecting planes.

The door portions can be collapsed comparatively easily from the pre-folded door position such that the entire opening operation of the folding door can be effected along the movement axis comparatively simply and using relatively little force. The collapsing of the folding door along the movement axis without the pre-folded door position could be made possible simply by using a large amount of force as a result of the door portions being arranged at the angle of 180° with respect to each other.

In one preferred embodiment of the invention, it is provided that the drive apparatus is realized as a linear drive. The linear drive includes a slider, the slider being positively guided along the movement axis.

In particular all drives or drive apparatuses which make a linear movement possible can be used as linear drives. All types of linear actuators, chain drives, cable drives, belt drives, in particular toothed belt drives and the like are conceivable here.

The linear drive can be realized in particular as a toothed belt drive and have a toothed belt and a slider, the toothed belt being arranged on the rail and guiding the slider. The rail is arranged in the narrow side of the folding door or horizontally such that the slider is guided along the movement axis. In addition, the toothed belt drive includes a motor, preferably an electric motor, which drives the slider. The electric motor is preferably arranged in the longitudinal side of the door frame. The toothed belt drive is distinguished by a small structural volume such that incorporation in the door frame, in particular also in retro, is made possible. In addition, the toothed belt drive has a long service life with a small amount of expenditure on maintenance and a small amount of noise development.

The slider of the linear drive includes the guiding member such that the driving fore of the drive apparatus is transferred to the guiding member and the guiding member is guided along the movement axis, in particular along the narrow side of the door frame. During the movement, there is temporary contact between the guiding member and the displacement element. At the contact, a force is transferred from the guiding member to the folding door in a vertical or angled manner with respect to the movement axis. The displacement element directs the force on via the door portion in the direction of the bend axis of the folding door such that the door portions are moved into the pre-folded door position.

In one further development, the displacement element is realized as an inclined plane, in particular in a wedge-shaped and/or ramp-shaped manner. The displacement element is arranged on a door portion of the folding door. The inclined plane or the wedge or the ramp points in the opposite direction of the movement of the guiding member during the opening operation such that the guiding member travels up the inclined plane or the wedge or the ramp during the opening operation of the folding door. One advantage of the further development is that the driving force of the drive apparatus when the guiding member and the displacement element contact each other is transferred in a continuously increasing manner to the bend axis such that an even, pleasant pre-bending of the door portions is achieved.

The inclined plane can, for example, be at an angle of between 5° and 80° with respect to the door portion. The inclined plane is preferably at an angle of between 15° and 60°, in a particularly preferred manner at an angle of between 25° and 45°.

A further possible development of the invention provides that the guiding member is realized as a roller which rolls along the displacement element. During the transfer of force from the roller to the displacement element, the roller is rotated about its own axis such that frictional force is reduced and consequently wedging or hooking can be prevented. The rotational axis of the roller is aligned at right angles to the movement axis and/or parallel to the surface extension of the closed folding door and/or perpendicularly.

The guiding member and the displacement element are preferably arranged on the inside of the aircraft toilet such that during the opening operation of the folding door, the folding mechanism hinges outward to the adjoining accommodation.

In a preferred embodiment of the invention, the slider of the linear drive has a receiving means and the folding door has a pulling pin. In particular, the pulling pin, when seen in top view from above, is arranged in the end region of the folding door at the free end thereof and protrudes beyond the folding door in the direction of the slider. The pulling pin is arranged in the receiving means of the slider such that the moved slider exerts a force onto the pulling pin along the movement axis. As a result, the pulling pin is entrained in the direction of movement and consequently enables the folding door to transfer between the closed and the open door position. The pulling pin and the receiving means in the slider consequently define a second force transferring path which is parallel to or independent from the first force transferring path.

In one possible further development, in a first phase the folding door is moved from the closed door position into a pre-folded door position, wherein the pulling pin is situated in a free run. The receiving means, in this connection, is constructed such that said receiving means does not exert any force onto the pulling pin during the first phase, but is moved in relation to the stationary pulling pin. A transfer of the driving force of the driving apparatus to the door portions still arranged with respect to each other at the angle of 180° is avoided in this manner.

In a second phase, the pulling pin is entrained by the receiving means so that the folding door is moved from the pre-folded door position into the open door position. The pulling pin is situated in the second phase at one end of the free run of the receiving means and is consequently entrained by the receiving means.

For the free run, the receiving means has at least a length in the direction of the movement axis of two centimeters and a maximum length of 20 centimeters. In a particularly preferred manner, the receiving means has a length of between five and ten centimeters.

In a third phase, the folding door is moved from the open door position into the closed door position by the receiving means of the slider moving the pulling pin into its original position and, as a result, the door portions along the narrow side of the door frame are once again arranged at an angle of 180° with respect to each other.

One advantage of the further development is that only one drive apparatus is needed for the operation of the pre-bending, opening and closing movement. For example, expenditure on costs and assembly can be reduced as a result. In addition, by combining the automatic pre-bending, opening and closing movement, manual operation of the folding door is no longer needed. Convenient operation of the folding door, in particular adapted to the needs of the disabled, is realized as a result.

In the case of a possible further development, the receiving means of the slider is realized as a slot-like recess, in particular as a slot, for the free run of the pulling pin. The slot-like recess, in its longitudinal extension in the direction of the movement axis, has a length which forms the free run for the pulling pin. The length of the slot-like recess is realized in such a manner that the pulling pin in not entrained through the slot-like recess in the first phase. From the second phase, i.e. from the presence of the pre-folded door position, the pulling pin reaches the end of the slot-like recess and is entrained along the narrow side of the door frame.

A further possible development of the invention provides that the pulling pin is adjustable in the axial direction of the pulling pin into an automatic holding position for automatic operation of the folding door, into a manual holding position for manual operation of the folding door and/or into a removal position for the removal of the folding door. In the case of the automatic holding position, the pulling pin is situated in the receiving means of the slider such that the automatic opening and closing operation of the folding door is made possible by the drive apparatus. In the case of the manual holding position, the pulling pin is retracted out of the receiving means and is arranged in the door frame in such a manner that manual guiding of the pulling pin in the narrow side of the door frame is made possible. A failure of the drive control means consequently does not forcibly result in the aircraft toilet being out of use as the folding door can continue to be operated in a manual manner.

In the case of the removal position, the pulling pin is preferably retracted completely into the folding door such that the folding door is able to be removed.

As a supplementary option, the folding door can have a pivot pin on the opposite side, said pivot pin pivotably mounting the folding door on the door frame. The pivot pin can also be retracted completely for the removal position for example. Consequently, the folding door is able to be removed without the use of tools.

In a preferred embodiment of the invention, the automatically operated door system has a drive control means, which is realized for controlling the drive apparatus.

In a further preferred embodiment of the invention, sensors are arranged in the door frame and are realized for the purpose of detecting the position and/or the speed of the folding door. The sensors can be, for example, reed sensors. In particular, two positional sensors are arranged in the end regions of the narrow side of the door frame and detect the position of the pulling pin as end position data and forward said end position data to the drive control means. Said drive control means can deduce a closed or open door position from said data. Two speed sensors, which are arranged spaced apart from each other, are preferably present in the narrow side of the door frame. The speed sensors are realized, for example, for the purpose of, when detecting the position of the pulling pin, outputting a changeover signal for a slow or rapid door movement to the drive control means.

The automatically operated door is suitable, as already stated above, in particular for aircraft toilets, in general for arbitrary monuments, in particular separate rooms or accommodation in an aircraft. Toilets, wash rooms, shower rooms, day rooms, storage rooms, cupboards, changing rooms and the like are possible as monuments. In a corresponding manner, the invention also relates to a monument for the interior fittings of an aircraft, the monument including an automatically operated door system according to one development and/or configuration described beforehand. On account of the comparatively small amount of space required to open the folding door, where applicable, the access to the monument can be improved. In addition, new possibilities for arranging elements, in particular fitting elements, in the monuments are produced. Further advantages and advantageous effects are produced in particular from the designs above and below.

The invention relates in a further sense also to aircraft which have a monument as described previously.

Reference is made to the above designs on account of advantages.

BRIEF DESCRIPTION OF THE DRAWINGS

Further features, advantages and effects of the invention are produced from the following description of preferred exemplary embodiment of the invention, in which.

Parts that correspond to each other or are identical are in each case provided with the identical references in the FIGS.

DETAILED DESCRIPTION OF THE INVENTION

Figure 1:
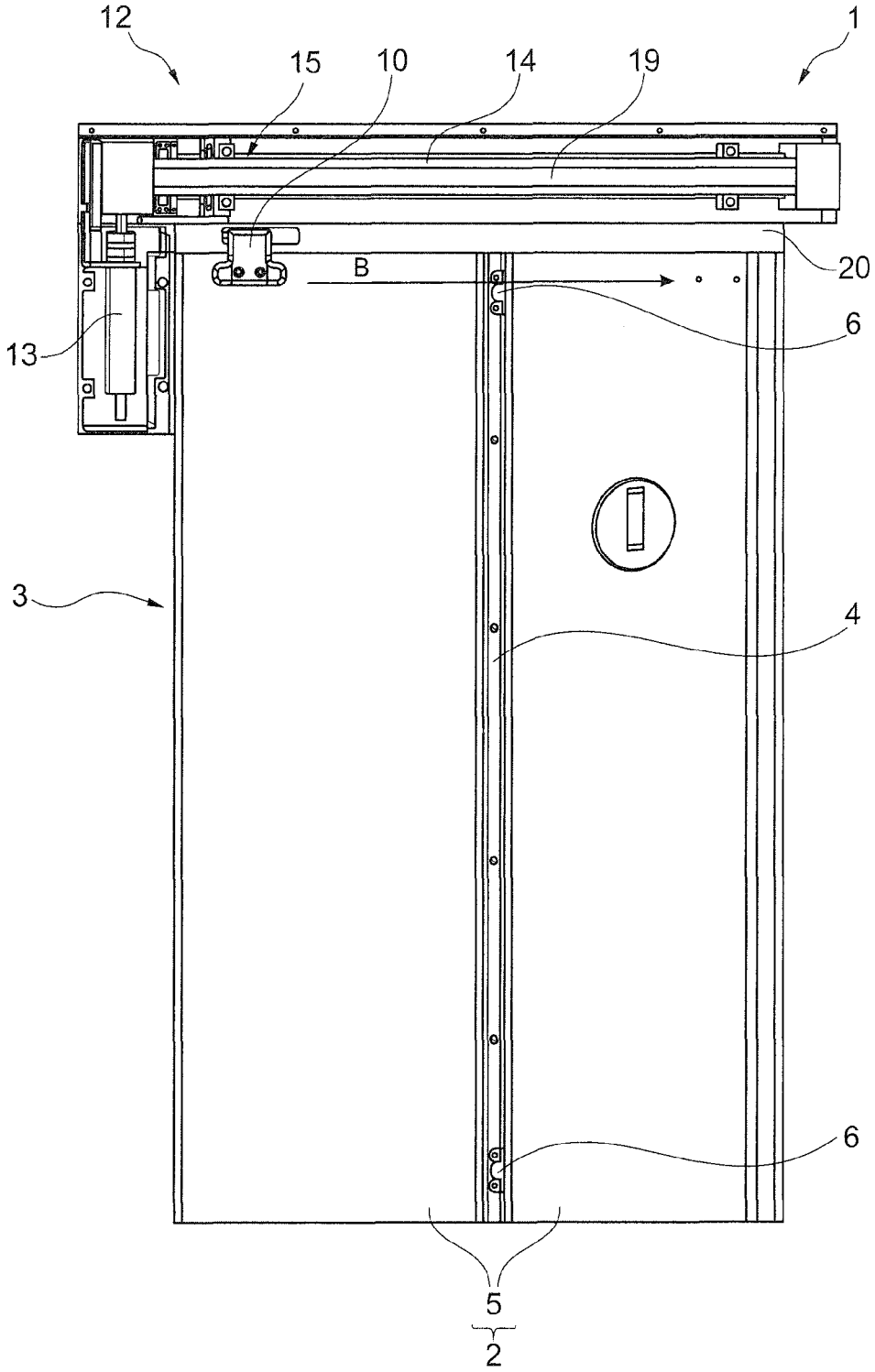
FIG. 1 shows an overall diagram of a door system as an exemplary embodiment of the invention.

FIG. 1 shows an overall diagram of a door system 1 as an exemplary embodiment of the invention. The door system 1 includes a folding door 2, the folding door 2 being arranged in a door frame 3 so as to be movable between a closed and an open door position. The folding door 2 is rectangular and includes a bend axis 4 centrally with respect to the folding door 2. By means of the bend axis 4, the folding door 2 has two door portions 5 of the same size. The two door portions 5 are connected together by means of hinges 6 and, as movable door portions 5, form the folding door 2. The folding door 2 preferably has on its narrow side a length of between 70 and 100 centimeters and on its longitudinal side a length of between 190 and 210 centimeters.

On its top side in the end region of the right-hand door portion 5—when viewed from FIG. 1, the folding door 2 includes a pivot pin 8 (FIGS. 4 to 7) which extends at right angles. The door frame 3 includes a receiving means in which the pivot pin 8 is arranged, the pivot pin 8 and the receiving means together forming a door hinge of the folding door 2 which is fixed with respect to the door frame 3.

On its top surface, extending at right angles in the end region of the left-hand door portion 5—when viewed from FIG. 1, the folding door 2 additionally includes a pulling pin 7. The pulling pin 7 and the pivot pin 8 are arranged at a maximum spacing of five centimeters, but in a particularly preferred manner between one half and three centimeters, from the respective ends of the folding door 2.

The direction of movement of the folding door 2 extends along a movement axis B, the movement axis B being arranged in a plane which is arranged parallel to the surface extension of the folding door 2 in the closed state and the movement axis B being arranged parallel to the narrow side of the door frame 3, to the floor or horizontally. In order to be able to move the folding door 2 between the closed and open door position, the pulling pin 7 is guided in a guide rail 20 (FIGS. 4 to 7) along the movement axis B.

The door system 1 includes a drive apparatus with a rail 14 and a slider 15, the slider 15 being arranged on the rail 14 so as to be displaceable along the movement axis B. The rail 14 extends over the narrow side of the folding door 2 along the movement axis B. In order to guide the pulling pin 7 along the movement axis B, said pulling pin is arranged in the slider 15 and is entrained by the latter.

The door frame 3, along the narrow side and in sections along the longitudinal side, has a recess in which the drive apparatus is arranged. The drive apparatus includes a toothed belt drive 12 and an electric motor 13, the electric motor 13 driving the toothed belt drive 12. The toothed belt drive 12 is arranged in the recess along the narrow side and the electric motor 13 is arranged at right angles to the toothed belt drive 12 in the recess along the longitudinal side. The toothed belt drive 12 is realized for the purpose of driving the slider 15.

Figure 2:
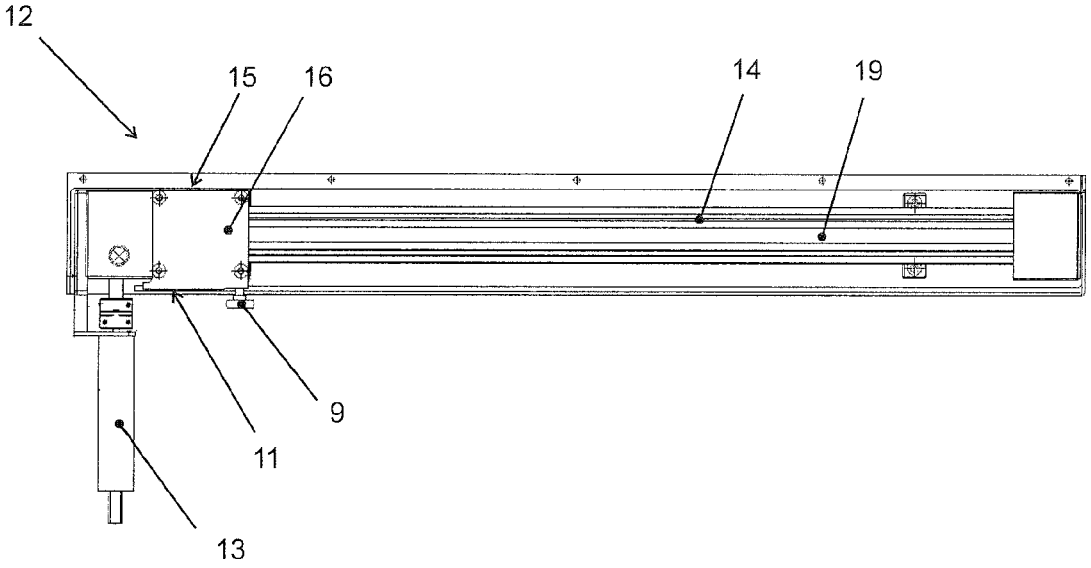
FIG. 2 shows a toothed belt drive in a front view of the door system of FIG. 1.

FIG. 2 shows the toothed belt drive 12, as it is arranged in the recess of the door frame 3 according to FIG. 1. The toothed belt drive 12 has a toothed belt 19 which is guided along on the rail 14 and moves the slider 15. The rail 14 of the toothed belt drive 12 extends over the entire narrow side of the folding door 2 such that the folding door 2 can be completely opened and closed.

A problem during the opening operation of the folding door 2 is the closed door position, where the door portions 5, when seen in top view from above, are arranged at an angle of 180° with respect to each other. Collapsing the folding door 5 along the movement axis B could simply be made possible by using a high amount of force. Consequently, it is advantageous to move the folding door 2 in a first phase first of all from a closed door position into a pre-folded door position. In the case of the pre-folded door position, the door portions 5 are situated at an angle of less than 180° with respect to each other such that in a second phase the folding door 2 can be moved along the movement axis B from the pre-folded door position into the open door position without using a large amount of force.

For the change in position from the closed door position into the pre-folded door position, a guiding member, realized as a roller 9, is arranged on the slider 15, and a displacement element is arranged on the folding door 2. The displacement element is realized as a wedge 10 and—when seen from FIG. 1—is fastened on the left-hand door portion 5. The roller 9 is moved along the movement axis B by the slider 15, it temporarily contacting the wedge 10 during the movement. The contact brings about a transfer of the driving force of the toothed belt drive 12 via the roller 9 to the wedge 10. The wedge 10 forwards the driving force to the bend axis 4 such that the folding door 2 moves from the closed door position into the pre-folded door position.

Figure 3:
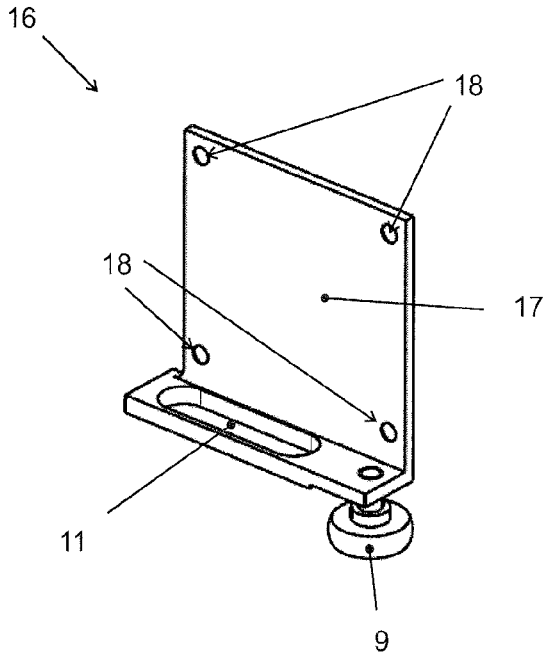
FIG. 3 shows a three-dimensional view of an adapter device of the toothed belt drive from FIG. 2 for a pre-bending and opening mechanism of the folding door.

FIG. 3 shows a three-dimensional view of an adapter device 16 which is realized as part of a pre-bending, opening and closing mechanism of the folding door 2. The adapter device 16 has a supporting plate 17 with bores 18 and is fastened to the slider 15 by means of screws which are guided through the bores 18. Consequently, the adapter device 16 is guided by the slider 15 along the movement axis B. In addition, the adapter device 16 includes the roller 9, the roller 9 being arranged on the adapter device 16 in such a manner that the rotational axis of the roller 9 extends vertically in the direction of the folding door 2.

Apart from the named screw fastenings for the adapter device 16, other types of fastenings such as, in particular, bonding, welding and the like are possible. In addition, it is also possible in principle for the slider 15 and the adapter device 16 to be realized as one single component, i.e. in one piece. A corresponding one-piece component can be connected or can connect, for example, directly to the toothed belt drive 12, more precisely to a toothed belt of the toothed belt drive 12.

The adapter device 16 includes a slot-like recess 11 in which the pulling pin 7 is arranged and is entrained through the same along the movement axis B. In order to avoid the pulling pin 7, in the closed door position, exerting a force onto the door portions 5 arranged at an angle of 180° with respect to each other, the slot-like recess 11 has a length which makes a free run possible for the pulling pin 7. The length of the slot-like recess 11 is dimensioned for the free run in such a manner that in the first phase the pulling pin is not entrained through the slot-like recess 11.

In an advantageous manner, the folding door 2 is consequently moved into the pre-folded door position in the first phase by the roller 9 and the wedge 10 without force-acting resistance provided by the pulling pin 7. As the second phase starts, i.e. from the presence of the pre-folded door position, the end of the slot-like recess 11 is reached by the pulling pin 7 and the pulling pin 7 is guided through the slot-like recess 11 along the narrow side of the door frame.

Reference is made to FIGS. 4 to 7 for the method of operation of the pre-bending, opening and closing mechanism in the individual door positions.

Figure 4:
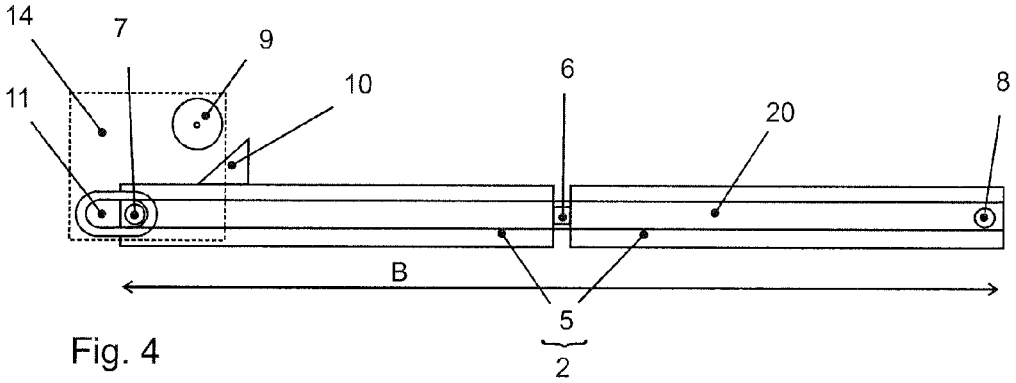
FIG. 4 shows a top view of a folding door from FIG. 1 in a closed door position.

FIG. 4 shows a top view from above of the folding door 2 in the closed door position where the door portions 5 are arranged at an angle of 180° with respect to each other. The roller 9 and the slot-like recess 11 of the adapter device 16 are also shown. When the adapter device 16 is driven by means of the slider 15, the slot-like recess 11 and the roller 9 are guided along the movement axis B. The pulling pin 7 is situated in the free run in said first phase such that the slot-like recess 11 is moved in relation to the stationary pulling pin 7.

Figure 5:
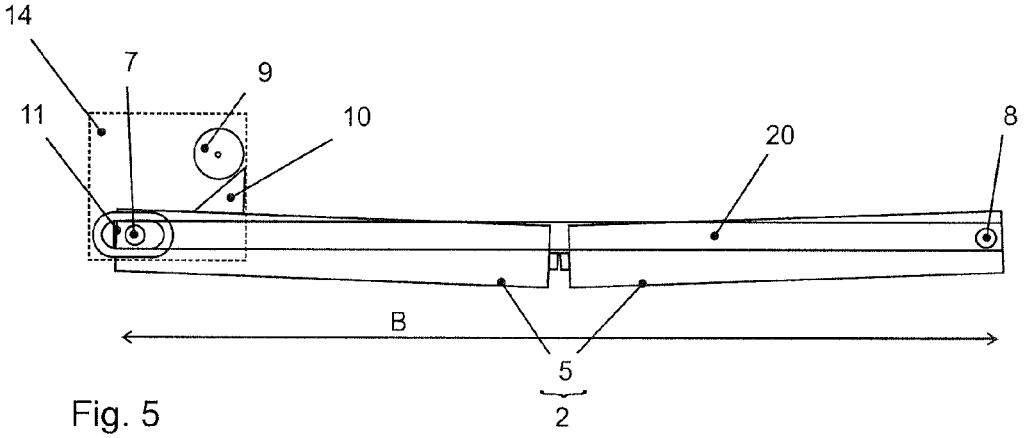
FIG. 5 shows a top view of the folding door from FIG. 4 with a change in position from the closed door position into a pre-folded door position.

FIG. 5 shows a top view of the folding door 2 in the case of a change in position from the closed door position into a pre-folded door position. When the position is changed, there is temporary contact between the roller 9 and the wedge 10 such that through the continuing movement of the roller 9, a force acts on the wedge 10. Consequently, via the roller 9, the force is transferred by means of the left-hand door portion 5—when seen from FIG. 5—in the direction of the bend axis 4 of the folding door 2, such that the door portions 5 move into the pre-folded door position. To reduce the friction resistance, the roller 9 is rotated about its own axis during the contact. The pulling pin 7 is still situated in the free run during the change in position and is consequently not yet entrained along the movement axis B. The roller 9 and the wedge 10 are arranged on that side of the folding door 2 where the hinge 6, in the event of force being transferred to the folding door 2, allows a folding operation of the folding mechanism such that the folding door 2 is able to move from the closed door position into the pre-folded door position.

Figure 6:
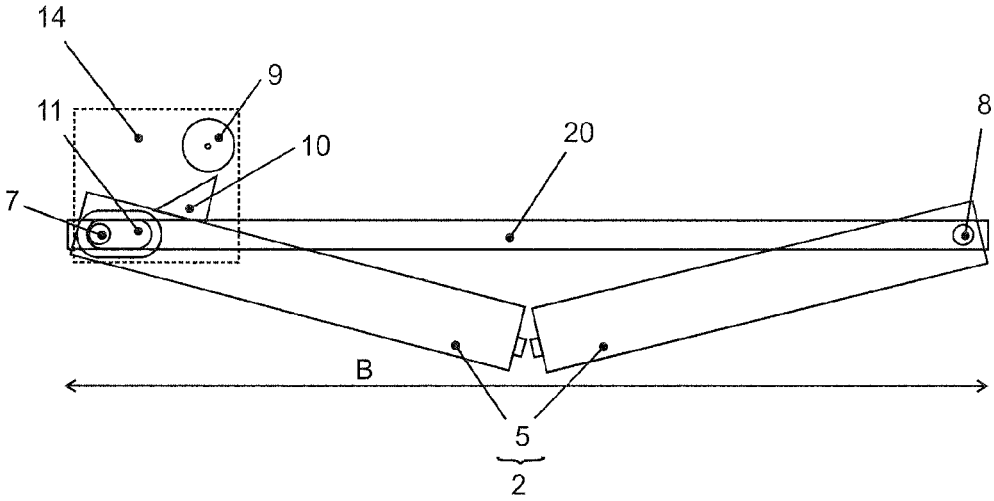
FIG. 6 shows a top view of the folding door of the preceding FIGS. in the pre-folded door position.

FIG. 6 shows a top view of the folding door 2 in the pre-folded door position. In the case of the pre-folded door position, the roller 9 has passed the wedge 10 and the pulling pin 7 is situated at end of the free run. Consequently, the pulling pin 7 is entrained in the following movement of the adapter device 16 through the slot-like recess 11 along the movement axis B.

Figure 7:
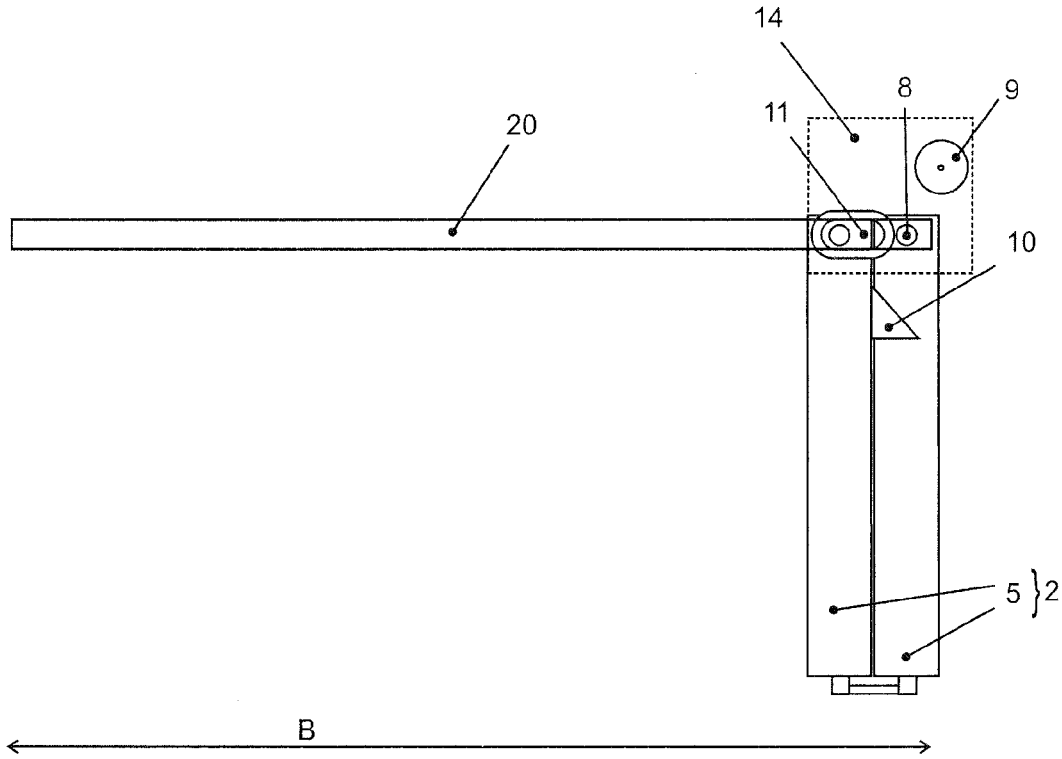
FIG. 7 shows a top view of the folding door of the preceding FIGS. in an open door position.

FIG. 7 shows a top view of the folding door 2 in an open door position. In the case of the open door position, the pulling pin 7 has been guided by the slot-like recess 11 along the movement axis B until the door portions 5 are arranged at right angles or at least approximately at right angles with respect to the narrow side and/or longitudinal side of the door frame. So that the two door portions 5 can be collapsed, the wedge 10 preferably points beyond the folding door 2 and is arranged, for example, in the door frame 3. As an alternative to this, the wedge 10 is arranged completely on the door portion 5. In this case, the door portions 5 are not collapsed completely during the opening operation as a result of the inclined plane.

For the closing operation of the folding door 2, the slot-like recess 11 guides the pulling pin 7 back along the movement axis B until the door portions 5 are arranged along the narrow side of the door frame 3 at an angle of 180° with respect to each other and the folding door 2 is situated in the closed door position.

Figure 8A:
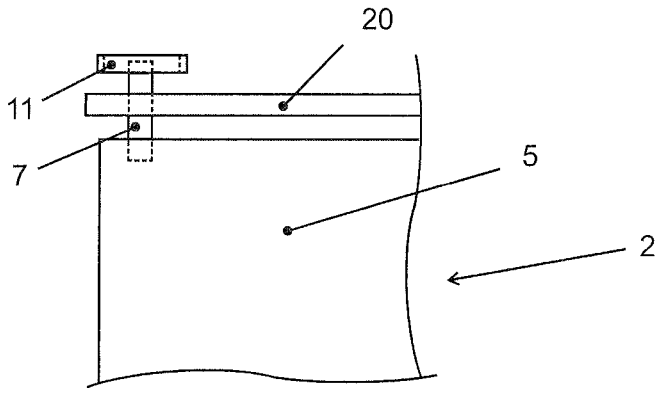
FIG. 8*a* shows a pulling pin of the folding door of the preceding FIGS. in an automatic holding position.

FIG. 8*a* shows the pulling pin 7 of the folding door 2 in an automatic holding position. In the case of the automatic holding position, the pulling pin 7 extends through the running rail 20 and is arranged in the slot-like recess 11. As a result, the opening and closing operation of the folding door 2 is performed automatically.

Figure 8B:
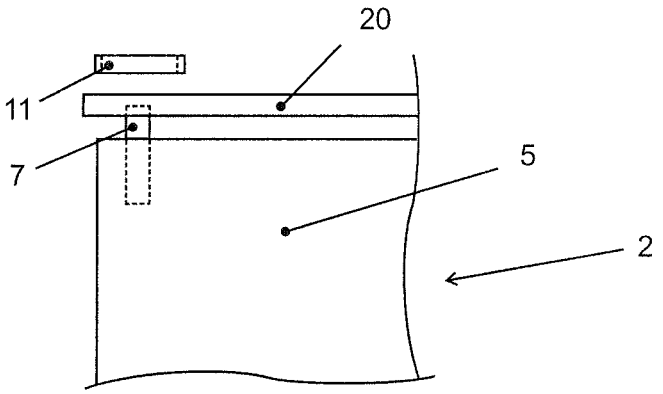
FIG. 8*b* shows the pulling pin of the folding door of the preceding FIGS. in a manual holding position.

FIG. 8*b* shows the pulling pin 7 of the folding door 2 in a manual holding position. In the case of the manual holding position, the pulling pin 7 is retracted by a certain length into the folding door 2 such that the pulling pin 7 is no longer arranged in the slot-like recess 11, but only in the running rail 20. Consequently, a manual opening and closing operation of the folding door 2 is made possible.

Figure 8C:
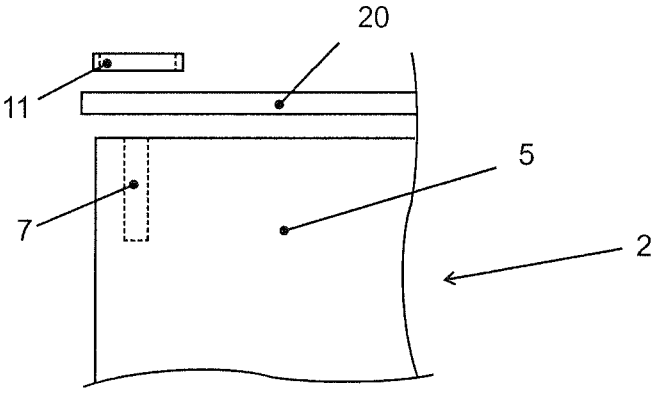
FIG. 8*c* shows the pulling pin of the folding door of the preceding FIGS. in a removal position.

FIG. 8*c* shows the pulling pin 7 of the folding door 2 in a removal position. In the case of the removal position, the pulling pin 7 is completely retracted into the folding door 2. As a supplementary option, the pivot bolt 8 can be retracted into the folding door 2. The folding door 2 is consequently able to be removed without the use of tools.

The door system has been described in the FIGS. using a toothed belt drive as an example. It should, however, be mentioned that other drives or drive apparatuses can also be used which enable a linear movement for example of the slider 15 and of the adapter device 16. All types of linear drives, in particular linear actuators, chain drives, cable drives and the like are conceivable here.

LIST OF REFERENCES

1 Door system
2 Folding door
3 Door frame
4 Bend axis
5 Door portion
6 Hinge
7 Pulling pin
8 Pivot pin
9 Roller
10 Wedge
11 Slot-like recess
12 Toothed belt drive
13 Electric motor
14 Rail
15 Slider
16 Adapter device
17 Supporting plate
18 Bore
19 Toothed belt
20 Running rail
B Movement axis

What is claimed is:

1. An automatically operated door system for an aircraft toilet, comprising:

a folding door, a door frame, wherein the folding door is arranged in the door frame to be movable between a closed door position and an open door position, a drive apparatus configured to move the folding door between the closed door position and the open door position, a guiding member coupled to the drive apparatus, and a displacement element arranged on the folding door, wherein the displacement element is fixedly fastened to the folding door, such that the entire displacement element is not movable with respect to the folding door, wherein the guiding member is configured to engage the displacement element to transfer the driving force of the drive apparatus to the displacement element, thereby moving the folding door from the closed door position into a pre-folded door position, and wherein when the folding door is being moved from the closed door position into the pre-folded door position, a temporary contact is implemented between the guiding member and the displacement element, such that through a continuing movement of the guiding member, a force is applied on the displacement element.

2. The automatically operated door system according to claim 1, wherein the displacement element comprises a wedge or a ramp.

3. The automatically operated door system according to claim 1, wherein the guiding member comprises a roller.

4. The automatically operated door system according to claim 1, wherein the folding door has a bend axis arranged centrally with respect to the folding door.

5. The automatically operated door system according to claim 1, further comprising a drive control means for actuating the drive apparatus.

6. The automatically operated door system according to claim 1, wherein sensors, which detect at least one of the position and the operating speed of the folding door, are arranged in the door frame.

7. The automatically operated door system according to claim 1, wherein the drive apparatus comprises a linear drive, and said linear drive comprises a slider which is guided in a linear direction parallel to an opening direction of the folding door, and wherein the slider comprises the guiding member.

8. The automatically operated door system according to claim 7, wherein said linear drive comprises a toothed belt drive.

9. The automatically operated door system according to claim 7, wherein the slider comprises a receiving means and the folding door comprises a pulling pin, and wherein the pulling pin is arranged in the receiving means for pulling the folding door between the closed door position and the open door position.

10. The automatically operated door system according to claim 9, wherein the pulling pin is adjustable in the axial direction of the pulling pin into at least one of an automatic holding position for automatic operation of the folding door, a manual holding position for manual operation of the folding door and a removal position for the removal of the folding door.

11. The automatically operated door system according to claim 9, wherein in a first phase, the folding door is moved from the closed door position into the pre-folded door position and the pulling pin is situated in a free run, and wherein in a second phase, the pulling pin is entrained by the receiving means and the folding door is moved from the pre-folded door position into the open door position.

12. The automatically operated door system according to claim 11, wherein the receiving means of the slider comprises a slot for the free run of the pulling pin.

* * * * *